US011549218B2

(12) United States Patent
Fan et al.

(10) Patent No.: US 11,549,218 B2
(45) Date of Patent: Jan. 10, 2023

(54) DEVICE FOR DEACIDIFYING, REINFORCING AND STRENGTHENING ANCIENT BOOKS

(71) Applicant: SOUTH CHINA UNIVERSITY OF TECHNOLOGY, Guangdong (CN)

(72) Inventors: Huiming Fan, Guangdong (CN); Jianhua Chen, Guangdong (CN); Haibin Wang, Guangdong (CN); Qian Gan, Guangdong (CN); Jiahe Li, Guangdong (CN); Da Gao, Guangdong (CN); Mingfeng Guo, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 499 days.

(21) Appl. No.: 16/632,542

(22) PCT Filed: Dec. 31, 2018

(86) PCT No.: PCT/CN2018/126068
§ 371 (c)(1),
(2) Date: Jan. 21, 2020

(87) PCT Pub. No.: WO2019/105489
PCT Pub. Date: Jun. 6, 2019

(65) Prior Publication Data

US 2020/0157742 A1 May 21, 2020

(30) Foreign Application Priority Data

Nov. 28, 2017 (CN) ..... 201711219602.6

(51) Int. Cl.
*D21H 25/18* (2006.01)
*D21H 25/02* (2006.01)
*D21H 21/18* (2006.01)

(52) U.S. Cl.
CPC ..... *D21H 25/18* (2013.01); *D21H 21/18* (2013.01); *D21H 25/02* (2013.01)

(58) Field of Classification Search
CPC ..... D21H 25/18; D21H 25/02; D21H 21/18; B41M 7/0063; A61L 2/20; C09K 2109/00
See application file for complete search history.

(56) References Cited

U.S. PATENT DOCUMENTS 3,676,182 A * 7/1972 Smith ..... B41M 7/0063 427/326
3,703,353 A * 11/1972 Kusterer, Jr. et al. . D21H 25/18 427/255.394

(Continued)

FOREIGN PATENT DOCUMENTS

CN 1280023 C * 10/2006
CN 102242529 11/2011

(Continued)

OTHER PUBLICATIONS

"International Search Report (Form PCT/ISA/210) of PCT/CN2018/126068," dated Mar. 11, 2019, with English translation thereof, pp. 1-4.

*Primary Examiner* — Jose A Fortuna
(74) *Attorney, Agent, or Firm* — JCIPRNET

(57) ABSTRACT

A novel device for deacidifying, reinforcing and strengthening ancient books is provided. The device includes a double-open front door, a fan set, a dehumidifier, a vacuum pump, a light, a middle partition, a gas pipe hole, a rear panel, an ultrasonic atomizer, a gas pipe and a pulley track. The double-open front door is provided on one side face of the device. The middle partition divides the device into an upper part and a lower part, bottom faces of the upper part and the lower part are each provided with the fan set. The dehumidifier, the vacuum pump and the ultrasonic atomizer are arranged at an external surface of the rear panel opposite (Continued)

the double-open front door. The gas pipe locates at and runs through an upper part of the middle partition, and that section of the gas pipe is provided with the gas pipe hole The gas pipe is connected with the ultrasonic atomizer.

9 Claims, 2 Drawing Sheets

(56) References Cited

U.S. PATENT DOCUMENTS 3,771,958 A * 11/1973 Kusterer, Jr. ..... D21H 17/07 427/248.1
3,898,356 A * 8/1975 Williams ..... D21H 25/18 8/119
3,939,091 A * 2/1976 Kelly, Jr. ..... D21H 17/12 252/189
4,051,276 A * 9/1977 Williams ..... D21H 17/12 427/296
4,119,400 A * 10/1978 Kurz ..... A61L 2/204 422/298
4,522,843 A * 6/1985 Kundrot ..... B41M 7/0063 427/427
4,863,566 A * 9/1989 Warren ..... B41M 7/0063 162/182
5,137,760 A * 8/1992 Lundquist ..... B41M 7/0063 427/377
5,219,524 A * 6/1993 Evans, II ..... A47G 1/0616 8/115.53
5,238,648 A * 8/1993 Kremen ..... A47F 3/002 422/291
5,260,023 A * 11/1993 Evans, II ..... B65D 79/02 422/40
5,264,243 A * 11/1993 Wedinger ..... D21H 25/18 427/140
5,322,558 A * 6/1994 Wittekind ..... B41M 7/0063 556/51
5,433,827 A * 7/1995 Page ..... D21H 25/18 427/342
6,641,877 B2 * 11/2003 Johnson ..... D21H 25/18 428/447
6,645,298 B1 11/2003 Herren et al.
7,041,236 B2 * 5/2006 Farkas ..... C09K 3/30 106/287.19
9,464,383 B2 * 10/2016 Smith ..... D21H 25/18
2020/0157742 A1 * 5/2020 Fan ..... D21H 25/02

FOREIGN PATENT DOCUMENTS

CN 102644218 8/2012
CN 105544299 5/2016
CN 107881850 4/2018
CN 210792544 U * 6/2020 ..... B42D 17/00
CN 108004847 B * 8/2021 ..... D06M 11/38
CN 213867092 U * 8/2021
CN 215931739 U * 3/2022
CN 114493709 A * 5/2022
EP 1069238 1/2001
EP 3095913 11/2016
EP 3643834 A1 * 4/2020 ..... D06M 11/38
WO WO-2019105489 A1 * 6/2019 ..... D21H 21/18

* cited by examiner

DEVICE FOR DEACIDIFYING, REINFORCING AND STRENGTHENING ANCIENT BOOKS

CROSS-REFERENCE TO RELATED APPLICATION

This application is a 371 of international application of PCT application serial no. PCT/CN2018/126068, filed on Dec. 31, 2018, which claims the priority benefit of China application no. 201711219602.6, filed on Nov. 28, 2017. The entirety of each of the above mentioned patent applications is hereby incorporated by reference herein and made a part of this specification.

TECHNICAL FIELD

The present invention belongs to the field of paper making, and specifically relates to a novel device for deacidifying, reinforcing and strengthening ancient books.

BACKGROUND

Thousands of precious books, calligraphy and paintings, modern newspaper, files and other cultural relics are preserved in various libraries, museums and archives in China. Being the essence of the Chinese nation's excellent traditional culture and a significant constituent of the Chinese cultural heritage with important historic value, cultural value and information value, they possess an irreproducible historic significance. As a carrier of the literal essence, paper would suffer a critical situation by the increasing severe worm damage, acidification, mildew and breakage with the time flies. Paper is made from fibrous materials, and the stability of cellulose is one of the most important factors that maintain the physical performances of paper. Cellulose is relatively stable under neutral and alkalescent conditions and generally would not be hydrolyzed or oxidized. However, in an acidic condition, hydrolysis on the cellulose is enhanced due to the catalysis of acid. After the hydrolysis of cellulose, strength of paper is reduced by the decreased degree of polymerization, resulting in pulverization of paper over time. Thus, there's an urgent need of thorough deacidification research on paper documents. Although various researches on deacidifying paper documents have been carried out by the domestic and foreign research institutes, practical application of the deacidification technology has not been achieved till now.

Current deacidification technology mainly includes liquid phase deacidification and gaseous phase deacidification of which the principle is to neutralize the acid in paper by using an alkaline deacidifying agent so as to achieve deacidification.

The liquid phase deacidification mainly includes organic solution deacidification and aqueous solution deacidification.

The deacidification by organic solution mainly includes Weito method, FMC method, and barium hydroxide-methanol solution deacidification. The deacidification by organic solution has advantages of high deacidification efficiency, simple operation and low cost. Japan and western countries such as Germany, Italy, USA, and etc. mainly use deacidification by organic solution, but most of the organic solvents would cause dissolution of printing ink thereby staining the ancient books. Additionally, the organic solvents are combustible with strong toxicity which demands a high level of safety requirement for operation.

The deacidification by aqueous solution has advantages of environmental safety, easy operation, economy and good deacidifying effect, but deformation and crimping still exist in the treated paper documents, bringing influence on the handwriting and being difficult to deacidify the books in large scale. There's no deacidification technology to solve the problem of deacidifying an entire book by the aqueous solution so far. Paper would stick to each other if deacidification is directly carried out on the entire book which results in severe secondary damage. The ancient book must be separated into single pages before the processing and then rebound after the processing. The ancient book has a rather low strength over a long time and it would be easily damaged when being separated. After the book is immersed into the solution, the strength of paper becomes lower which brings severe secondary damage to the ancient books though the deacidification is carried out. Moreover, drying is required after the books are immersed into the solution. Aging and breakage of fiber are easily caused during the drying, thereby yellowing or even damaging the paper. Such method is complicated in process with long term, which is inappropriate for the ancient books.

The gaseous phase deacidification method mainly includes diethylzinc method and morpholine deacidification method.

The diethylzinc deacidification method: when meeting with the acidic hydrogen ion in paper, diethylzinc not only reacts with the acidic hydrogen ions in paper but also rapidly neutralizes the hydrogen in water to generate solid zinc oxide. Such solid zinc oxide remains on the surface of the paper and provides a certain deacidification effect. However, diethylzinc is spontaneously combustible when meeting with air, and great danger exists, that is, a great threat of fire to the paper documents. In addition, residues of zinc oxide accelerate the photooxidation on paper fibers, yellowing and aging the paper to some extent. Therefore, such method is not a good one.

The morpholine deacidification method: under normal circumstance, morpholine is in liquid state, and turns into gas when mixing with water in vacuum, so as to react with the hydrogen ions in paper to achieve deacidification. This method changes the color of paper easily, yellows the newspaper and magazines, and does not exerts reinforcement during the process. A large scale of promotion of such method is limited due to the high cost for equipment and instruments. From the aspect of deacidification technology abroad, in 1970s and 1980s, gaseous deacidification attracted people for its large scale of processing. However, its extensive application is limited by the high level requirement for technological conditions, potential safety hazard, great investment and uneven processing effect.

There are various similar gaseous phase and liquid phase deacidification technologies at home and abroad currently, but each of these still has defects such as high cost, high difficulty of operation, strong toxicity of deacidifying agent, failure to develop in large-scale, potential safety hazard, environmental pollution, etc. In recent years, studies of methods for atomizing the liquid phase deacidifying agent have been carried out by some researchers.

An arc discharge paper deacidifying device and a method (Zhejiang University, Xiwen Zhang, CN102644218A), wherein the device needs an inert gas as protective gas, and sprays an alkaline deacidifying agent on the surface of the paper to be tested by using an arc discharge spray gun. Its advantages lie in that compared with the conventional liquid phase deacidification, such device processes the paper in the air without impregnating the paper into a solution and no adhesion generates; compared with the conventional gas phase deacidification, such device presents shorter deacidification time and higher efficiency for a single piece of paper. Its disadvantages lie in that: 1. inert gas protection is required which brings a certain risk; 2. high voltage power supply of 5-10 kV is required which brings high energy consumption and high danger coefficient; and 3. spraying is suitable for processing a single piece of paper such as newspaper and the like, but it is difficult to process an entire ancient book.

A paper document deacidifying device and a method (Nanjing Museum, Liang Gong, CN105544299A), wherein the device processes the ancient book also by the direct spray method, that is, spraying the atomized alkaline deacidifying agent on the ancient book to be tested. The advantage thereof is that an automatic page-turning device is designed. The device sprays one page by automatically turning one page so as to reduce the complexity of manual operation. The disadvantage thereof is that the page-turning system has a certain requirement to the size and thickness of the book and sorting of ancient books is needed. Moreover, adhesion may be resulted if the paper is not dried completely after spraying.

A pressurizing, atomizing and deacidifying device and a method for pressurizing, atomizing and deacidifying by using the same (Guangdong University of Technology, Yanxiong Fang, CN102242529A), wherein the ancient books are placed in a closed device, and an alkaline deacidifying agent solution is pressurized, atomized and introduced into the device for deacidification. The advantage is that the simple process allows direct treatment to a large batch of ancient books. The disadvantages lie in that: 1. the liquid drop obtained by pressurizing and atomizing is relatively large so that the books are too humid and likely to adhere; and 2. even distribution of the atomized liquid drops in the device cannot be guaranteed and it is easy to cause uneven deacidification.

So far, a practically applicable deacidification method for ancient books has not been found. Although deacidification studies on paper documents have been developed by the research institutes home and abroad at present, a practically applicable deacidification technology has not been achieved so far, let alone that the deacidifying device matching the technology is rare.

Devices of the prior art all have defects such as high cost, high difficulty of operation, strong toxicity of deacidifying agent, failure to develop in large-scale, potential safety hazard, environmental pollution, etc. In conclusion, an effective device that can be applied practically has not been designed yet.

SUMMARY

In order to overcome the above deficiencies, the present invention provides a novel device for deacidifying, reinforcing and strengthening ancient books. The device of the present invention is to maintain the original temperature and humidity of paper without drying the paper, so that fibers would not be aged or broken, and the paper would not be yellowed or harmed.

A novel device for deacidifying, reinforcing and strengthening ancient books, includes a double-open front door, a fan set, a dehumidifier, a vacuum pump, a light, a middle partition, a gas pipe hole, a rear panel, an ultrasonic atomizer, a gas pipe and a pulley track; the device is in a shape of regular hexahedron; the double-open front door is provided on one side face of the regular hexahedron; the middle partition divides the device into an upper part and a lower part, bottom faces of the upper part and the lower part are each provided with the fan set; the dehumidifier, the vacuum pump and the ultrasonic atomizer are arranged at an external surface of the rear panel opposite the double-open front door; lights are provided all around a lower part of the middle partition; the gas pipe locates at and runs through an upper part of the middle partition, and that section of the gas pipe is provided with the gas pipe hole; the gas pipe is connected with the ultrasonic atomizer; and the pulley track is provided on the bottom face of the lower part of the device.

Further, the device further includes visible windows, both sides of the double-open front door and left and right sides of the device are provided with the visible windows.

Further, the device further includes a hygrometer, a piezometer and a pH meter; the hygrometer, the piezometer and the pH meter are all provided in the interior of the device.

Further, a PLC-control system is fixed on the double-open front door; the fan set, the dehumidifier, the vacuum pump, the ultrasonic atomizer, the lights and a bookrack are integrally controlled by the PLC-control system, by monitoring the hygrometer, the piezometer and the pH meter, real-time control of on-off of the lights, on-off of the fan, wind speed, on-off of the dehumidifier, air volume of the dehumidifier, on-off of the vacuum pump, wind speed of vacuum pumping, on-off of the ultrasonic atomizer, atomization volume, on-off of spinning of the bookrack and duration of spinning of the bookrack is performed.

Further, the device is made of an external material and an internal material, the external material is carbon steel, and the internal material is stainless steel; a whole airtightness of the device is good, and the system is maintained at room temperature in which vacuum or nearly vacuum can be reached. The device has a total width of 1 m-2.5 m, a height of 1 m-2.5 m, and a length of 3 m-12 m. The whole device is similar to a container, which can be transported to anywhere by a forklift and transportation facility. The device can also be placed in an air-tight room with walls around and atop, doors and windows of the room are closed, and the walls are subjected to moisture proof and mould proof treatments.

Further, the device further includes a water groove and a drain valve; the water groove is provided at the bottom face of the lower part of the device, locating at two sides of the device and the bottom face close to the rear panel; the water groove has a depth of 1-10 cm below the bottom face and a width of 1-10 cm; the water groove is connected to the drain valve, and the drain valve can be turned on to drain water out of the device when water accumulates to some extent. Two pulley tracks are provided, and a width between the two pulley tracks is consistent with the width of the bookrack so as to move the bookrack in or out.

Further, four visible windows in total made from toughened glass are provided at the front door and two side faces of the device. Size of the window is 0.1 m×0.1 m-2 m×2 m. Water proof and explosion proof lights are mounted at four corners of the bottom of the middle partition, which are convenient for the operator to check the interior of the device.

Further, the dehumidifier has a maximum dehumidification capacity of 0.5 kg/h-150 kg/h. The dehumidification capacity of the dehumidifier depends on an internal airtight volume of device. When the internal airtight volume of device is 10 $m^3$, the maximum dehumidification capacity of the dehumidifier is 0.5 kg/h-30 kg/h. By every 5 $m^3$ the internal airtight volume of device increases, the maximum dehumidification capacity of the dehumidifier increases by 0.5 kg/h-30 kg/h.

Further, the vacuum pump has a final vacuum of 0 to −0.08 MPa, and a maximum speed of evacuation of 5 $m^3$/h-500 $m^3$/h. The maximum speed of evacuation of the vacuum pump is proportional to a device volume. When the device volume is 10 $m^3$, the maximum speed of evacuation of the vacuum pump is 5 $m^3$/h-100 $m^3$/h. By every 5 $m^3$ the device volume increases, the maximum speed of evacuation of the vacuum pump increases by 1 $m^3$/h-100 $m^3$/h.

Further, the ultrasonic atomizer has an ultrasonic frequency of 15 kHz-120 kHz, a particle diameter after atomization of 1 nm-5 μm, and a humidification capacity of 0.5 kg/h-150 kg/h. The humidification capacity depends on a volume of the device. When an internal airtight volume of device is 10 $m^3$, a maximum humidification capacity of the ultrasonic atomizer is 0.5 kg/h-30 kg/h. By every 5 $m^3$ the internal airtight volume of device increases, the maximum humidification capacity of the ultrasonic atomizer increases by 0.5 kg/h-30 kg/h.

Further, the ultrasonic atomizer is connected with the separated upper part of the middle partition via the gas pipe. The gas pipe is provided with a gas pipe hole through which atomized gas evenly enters the upper part of the partition, and the atomized gas is led into the device by the fan on the partition.

Further, the air blower is made of a material that is insulating, water-proof and anti-corrosion, and it would not be damaged when placed in an aerosol environment for a long term. As a variable frequency air blower, air speed of the air blower can be adjusted. Air blower at the top of the front door of the device admits air from below and blows in a direction of entering the door. Air blower at the bottom of the rear panel of the device admits air from above and blows in a direction of exiting the door. Two groups of air blowers can guarantee a cycle of atomized gas within the internal airtight space of the device, allowing the device to be filled with atomized gas without any blind side.

Further, the middle partition is provided with an air outlet thereon. Since the closer to the fan, the higher the air velocity, an area of the air outlet increases with a distance from the fan set in a direction from the near to the distant. Thus, velocity at which the atomized gas flows out of the partition is uniform, ensuring even distribution of the atomized gas.

Further, the bookrack is made of stainless steel, with wheels at the bottom, and it can be loaded with books before being pushed into the device for deacidification. The bookrack is provided with a link chain of stainless steel. A book basket is fixed on the link chain which is driven by a motor. After the motor is on, the book basket runs upward and downward so that more even absorption of atomized gas for the books is obtained. The book basket is designed as slightly wider at the top and slightly narrower at the bottom. The ancient books are opened laterally and placed with a lateral side facing upward. Wind coming from the fan from top to bottom opens the ancient books slightly, allowing more even permeation of a deacidifying agent.

Compared with the prior art, advantages of the present invention lie in that:

By using ultrasonic atomization, particle size of the atomized liquid drop is far smaller than that by the prior pressurized atomization (spraying atomization belongs to one of the pressurized atomization). The device is provided with a fan set which guarantees even distribution of the atomized gas within the device. Meanwhile, the bookrack is movable which further guarantees uniformity of the deacidification. The deacidifying agent is added after dehumidification, and original humidity of the ancient books would not be changed, accelerating the absorption of the deacidifying agent for the ancient books and as well as the deacidification.

Figure 1:
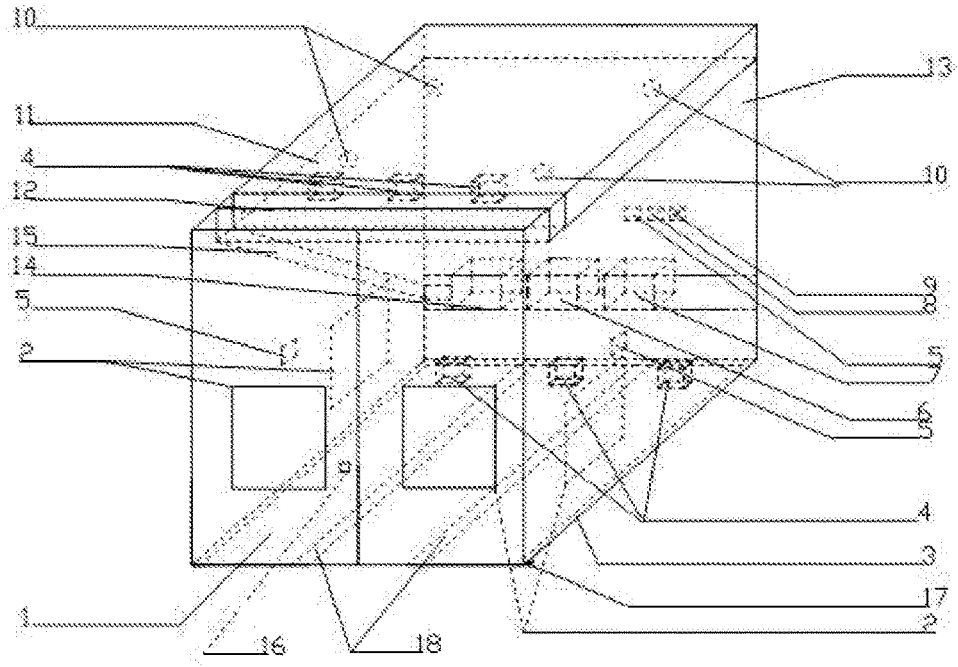
FIG. 1 is a structural diagram of a device for deacidifying, reinforcing and strengthening ancient books in the present invention.

Each component in the figures is as follows: double-open front door 1, visible window 2, water groove 3, fan set 4, hygrometer 5, dehumidifier 6, vacuum pump 7, piezometer 8, pH meter 9, light 10, middle partition 11, gas pipe hole 12, rear panel 13, ultrasonic atomizer 14, gas pipe 15, PLC-control system 16, drain valve 17, pulley track 18, bookrack 19, and air outlet 20.

DETAILED DESCRIPTION

The present invention is further described in detail by combining the following specific embodiment, but the implementation of the present invention is not limited thereto. Those technological parameters which are not described particularly can be carried out by referring to conventional technologies.

Figure 2:
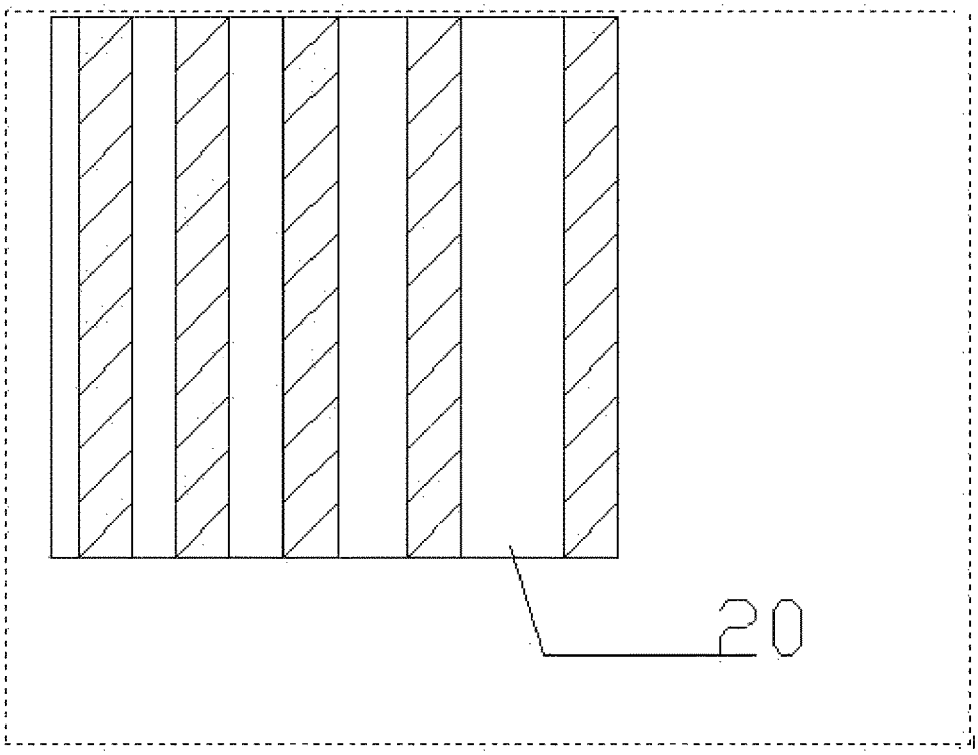
FIG. 2 is a structural diagram of a middle partition.
Figure 3:
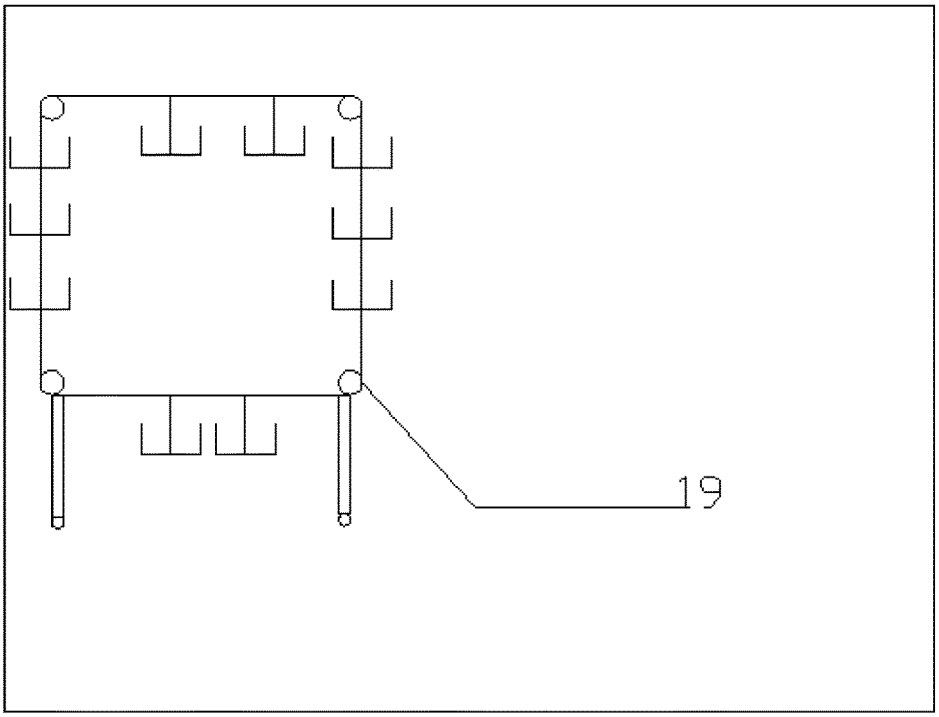
FIG. 3 is a structural diagram of a bookrack.
Figure 4:
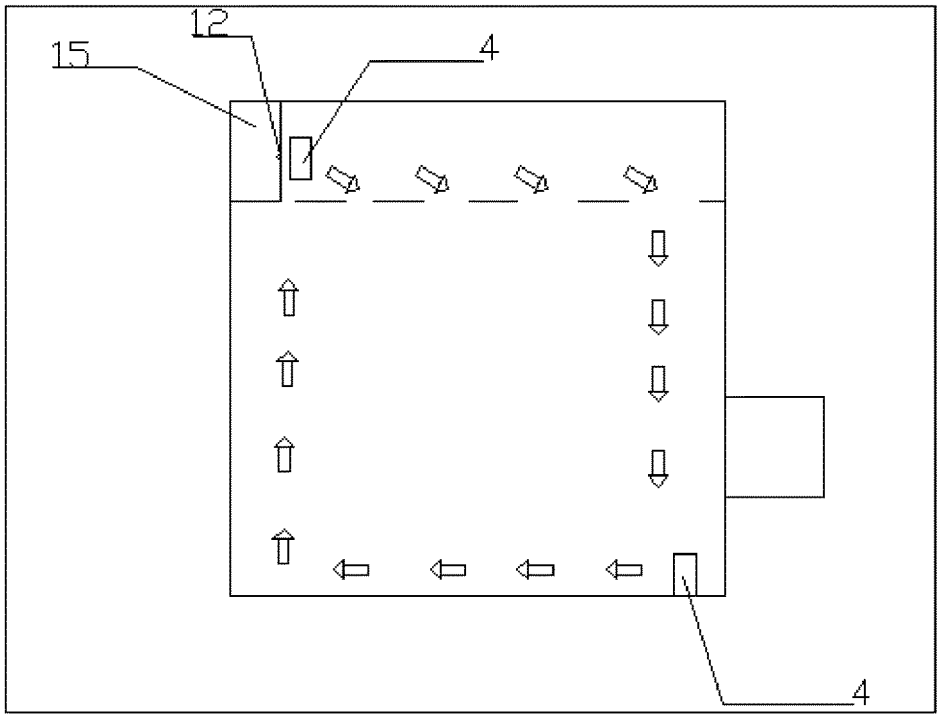
FIG. 4 is an air flow diagram showing change of a direction of wind in a system within the device of the present invention.

As shown in FIG. 1 to FIG. 4, a novel device for deacidifying, reinforcing and strengthening ancient books, includes a double-open front door 1, a fan set 4, a dehumidifier 6, a vacuum pump 7, a light 10, a middle partition 11, a gas pipe hole 12, a rear panel 13, an ultrasonic atomizer 14, a gas pipe 15 and a pulley track 18; the double-open front door 1 is provided on one side face of the device; the middle partition 11 divides the device into an upper part and a lower part, bottom faces of the upper and lower parts are each provided with the fan set 4; the dehumidifier 6, the vacuum pump 7 and the ultrasonic atomizer 14 are arranged at an external surface of the rear panel 13 opposite the double-open front door 1; lights 10 are provided all around a lower part of the middle partition; the gas pipe 15 locates at and runs through an upper part of the middle partition 11, and that section of the gas pipe is provided with the gas pipe hole 12, the gas pipe 15 is connected with the ultrasonic atomizer 14; and the pulley track 18 is provided on the bottom face of the lower part of the device. The device further includes visible windows 2. Both sides of the double-open front door 1 and left and right sides of the device are provided with the visible windows 2. The device further includes a hygrometer 5, a piezometer 8 and a pH meter 9; the hygrometer 5, the piezometer 8 and the pH meter 9 are all provided in the interior of the device. A PLC-control system 16 is fixed on the double-open front door 1; the fan set 4, the dehumidifier 6, the vacuum pump 7, the ultrasonic atomizer 14, the lights 10 and a bookrack 19 are integrally controlled by the PLC-control system, by monitoring the hygrometer 5, the piezometer 8 and the pH meter 9, real-time control of on-off of the lights, on-off of the fan, wind speed, on-off of the dehumidifier, air volume of the dehumidifier, on-off of the vacuum pump, wind speed of vacuum pumping, on-off of the ultrasonic atomizer, atomization volume, on-off of spinning of the bookrack and duration of spinning of the bookrack is performed. The device is made of an external material and an internal material, the external material is carbon steel, and the internal material is stainless steel; the device has a total width of 1 m-2.5 m, a height of 1 m-2.5 m, and a length of 3 m-12 m. The device further includes a water groove 3 and a drain valve 17; the water groove is provided at the bottom face of the lower part of the device, locating at two sides of the device and the bottom face close to the rear panel; the water groove 3 has a depth of 1-10 cm below the bottom face and a width of 1-10 cm; the water groove 3 is connected to the drain valve 17; two pulley tracks 13 are provided, and a width between the two pulley tracks 13 is consistent with the width of the bookrack 19. The middle partition 11 is provided with an air outlet 20 thereon, since the closer to the fan, the higher the air velocity, an area of the air outlet increases with a distance from the fan set in a direction from the near to the distant. The bookrack 19 is made of stainless steel, with wheels at the bottom; the bookrack is provided with a link chain of stainless steel, a book basket is fixed on the link chain which is driven by a motor; after the motor is on, the book basket runs upward and downward so that more even absorption of atomized gas for the books is obtained; the book basket is designed as slightly wider at the top and slightly narrower at the bottom, the ancient books are opened laterally and placed with a lateral side facing upward, wind coming from the fan set 4 from top to bottom opens the ancient books slightly, allowing more even permeation of a deacidifying agent.

Operational mechanism of deacidification, repair and reinforcement:

Opening the double-open front door 1 and turning the lights 10 on, pulling out the bookrack 19 on the pulley tracks, placing the ancient books to be treated on the bookrack, then pushing the bookrack 19 back into the device, and closing the double-open front door 1. By the PLC-control system 16, turning the fan set 4 on to maintain the airflow inside the device, then turning the vacuum pump 7 on and observing a system internal pressure through the piezometer 8. Turning the vacuum pump off when a target pressure is reached. Selecting and adding 1 to 50 L of a required deacidifying agent solution, reinforcing agent solution or strengthening agent solution (for example, NaOH solution, $Ca(OH)_2$ solution, $Cu(OH)_2$ solution, $Fe(OH)_3$ solution, KOH solution, $Na_2CO_3$ solution, $NaHCO_3$ solution, $NH_3.H_2O$, ethanediamine solution, phosphate solution, borate solution, nanocellulose, polyvinyl alcohol solution, styrene-butadiene latex) to the ultrasonic atomizer 14 on the rear panel outside the device. Turning the ultrasonic atomizer on, monitoring a system internal humidity through the hygrometer 5, adjusting an atomization volume of the ultrasonic atomizer 14 by using the PLC-control system, allowing the system internal humidity to be maintained at a stable range so as to deacidify and reinforce the ancient books inside the system. When the treatment for the ancient books inside the system is completed, turning the ultrasonic atomizer off through the PLC-control system 16 and turning the dehumidifier on to draw the rest of the atomized gas of agents out of the system. After a while, turning off the whole system, then opening the double-open front door 1, and taking the ancient books out from the bookrack 19.

What is claimed is:

1. A novel device for deacidifying, reinforcing and strengthening ancient books, wherein the device comprises a double-open front door, a fan set, a dehumidifier, a vacuum pump, a light, a middle partition, a gas pipe hole, a rear panel, an ultrasonic atomizer, a gas pipe and a pulley track;

the device is in a shape of regular hexahedron;

the double-open front door is provided on one side face of the regular hexahedron;

the middle partition divides the device into an upper part and a lower part, bottom faces of the upper part and the lower part are each provided with the fan set;

the dehumidifier, the vacuum pump and the ultrasonic atomizer are arranged at an external surface of the rear panel opposite the double-open front door;

lights are provided all around a lower part of the middle partition;

the gas pipe locates at and runs through an upper part of the middle partition, and that section of the gas pipe is provided with the gas pipe hole, the gas pipe is connected with the ultrasonic atomizer; and the pulley track is provided on the bottom face of the lower part of the device.

2. The novel device for deacidifying, reinforcing and strengthening ancient books according to claim 1, wherein the device further comprises visible windows;

both sides of the double-open front door and left and right sides of the device are provided with the visible windows.

3. The novel device for deacidifying, reinforcing and strengthening ancient books according to claim 1, wherein the device further comprises a hygrometer, a piezometer and a pH meter;

the hygrometer, the piezometer and the pH meter are all provided in the interior of the device.

4. The novel device for deacidifying, reinforcing and strengthening ancient books according to claim 1, wherein a PLC-control system is fixed on the double-open front door;

the fan set, the dehumidifier, the vacuum pump, the ultrasonic atomizer, the lights and a bookrack are integrally controlled by the PLC-control system, by monitoring the hygrometer, the piezometer and the pH meter, real-time control of on-off of the lights, on-off of the fan set, wind speed, on-off of the dehumidifier, air volume of the dehumidifier, on-off of the vacuum pump, wind speed of vacuum pumping, on-off of the ultrasonic atomizer, atomization volume, on-off of spinning of the bookrack and duration of spinning of the bookrack is performed.

5. The novel device for deacidifying, reinforcing and strengthening ancient books according to claim 4, wherein the device further comprises a water groove and a drain valve;

the water groove is provided at the bottom face of the lower part of the device, locating at two sides of the device and the bottom face close to the rear panel; the water groove has a depth of 1-10 cm below the bottom face and a width of 1-10 cm; the water groove is connected to the drain valve;

two pulley tracks are provided, and a width between the two pulley tracks is consistent with the width of the bookrack.

6. The novel device for deacidifying, reinforcing and strengthening ancient books according to claim 4, wherein the bookrack is made of stainless steel, with wheels at the bottom;

the bookrack is provided with a link chain of stainless steel, a book basket is fixed on the link chain which is driven by a motor; after the motor is on, the book basket runs in cycle driven by the link chain so that more even absorption of atomized gas for the books is obtained;

the book basket is designed as slightly wider at the top and slightly narrower at the bottom, the ancient books are opened laterally and placed with a lateral side facing upward, wind coming from the fan set from top to bottom opens the ancient books slightly, allowing more even permeation of a deacidifying agent;

size of the bookrack is smaller than size of the front door of the device so as to move the bookrack in or out;

a plurality of bookracks can be placed in the device, and a number of the bookrack depends on a total volume of the device.

7. The novel device for deacidifying, reinforcing and strengthening ancient books according to claim 1, wherein the device is made of an external material and an internal material, the external material is carbon steel, and the internal material is stainless steel;

the device has a total width of 1 m-2.5 m, a height of 1 m-2.5 m, and a length of 3 m-12 m.

8. The novel device for deacidifying, reinforcing and strengthening ancient books according to claim 1, wherein the device is placed in an air-tight room with walls around and atop, doors and windows of the room are closed, and the walls are subjected to moisture proof and mould proof treatments.

9. The novel device for deacidifying, reinforcing and strengthening ancient books according to claim 1, wherein the middle partition is provided with an air outlet thereon, an area of the air outlet increases with a distance from the fan set at the upper part in a direction from the near to the distant; the closer to the fan set, the higher the air velocity; the farther away the fan set, the lower the air velocity.

* * * * *